US005593131A

United States Patent [19]

Briggs, Jr. et al.

[11] Patent Number: 5,593,131

[45] Date of Patent: Jan. 14, 1997

[54] VARIABLE ORIFICE PLATE FOR COAL PIPES

[75] Inventors: Oliver G. Briggs, Jr., Jefferson; John A. Sund, Jr., Oakham, both of Mass.

[73] Assignee: DB Riley, Inc., Worcester, Mass.

[21] Appl. No.: 559,169

[22] Filed: Nov. 13, 1995

[51] Int. Cl.[6] ..... F16K 51/00

[52] U.S. Cl. ..... 251/117; 251/305

[58] Field of Search ..... 251/117, 305; 137/630

[56] References Cited

U.S. PATENT DOCUMENTS

| | | | |
|---|---|---|---|
| 1,477,824 | 12/1923 | Grindle | 110/265 |
| 1,708,496 | 4/1929 | Clendon | 431/188 |
| 2,079,420 | 5/1937 | Nielsen | 110/104 B |
| 2,676,604 | 4/1954 | Senna | 251/117 |
| 3,002,472 | 10/1961 | Miller | 110/106 |
| 4,459,922 | 7/1984 | Chadshay | 110/265 |
| 5,342,019 | 8/1994 | Braun et al. | 251/305 |

*Primary Examiner*—Noah P. Kamen
*Attorney, Agent, or Firm*—Mason, Kolehmainen, Rathburn & Wyss

[57] ABSTRACT

A flow control apparatus for a coal pipe containing a stream of primary combustion air carrying pulverized solid fuel particles, includes a frame sealingly secured to an outside surface of the coal pipe around a window opening formed on one side of the pipe. An orifice plate having an orifice opening at the center is supported for pivotal movement in the coal pipe on a spindle extending radially outwardly from an edge portion on one side of the orifice plate and out through the window opening in the pipe. A bearing sleeve is provided for supporting the spindle for rotating movement about a spindle axis extending transversely of the coal pipe across the center thereof. A mounting plate structure for the sleeve is provided and is attached to the frame. A removable handle is attached on an outer end of the spindle for rotating the orifice plate in the coal pipe to vary the effective flow cross-section of the orifice opening for controlling the flow of coal and primary air to a burner.

11 Claims, 2 Drawing Sheets

14
16
18
20
22
24
25
26
28
30
32
34
35
37
38
39
40
42
44
46
48
50
52
54
56
57
58
59
60
62
70
72
74
76
78
80
82
86
88
A
B
10
12

VARIABLE ORIFICE PLATE FOR COAL PIPES

BACKGROUND OF THE INVENTION

1. Field of the Invention

The present invention relates to a new and improved variable orifice plate for controlling the flow in coal pipes supplying burners in furnaces and boilers. More particularly, the present invention is directed to an orifice plate mounted in a coal pipe and movable between alternate positions to vary the effective flow cross-section for controlling the flow of primary coal and air to a burner. By adjusting the angle of tilt of the orifice plate relative to the general direction of flow along a coal pipe, the effective flow cross-section through the orifice opening is varied and adjustments can be made while on-line during operation of a burner so that the effects of position settings are rapidly available and easily tabulated without requiring the burner to be shut down. 2. Background of the Prior Art There has been an historical problem of obtaining balanced pulverized coal flow in multiple coal pipe distribution systems. Typically, coal pipes are manifolded from the discharge of a pulverizer. A manifold can be in the form of a classifier, a flow splitter or a riffle box. Previously, a method used to equalize coal flow to each burner was to throttle each coal line to obtain equal pressure drops through all of the multiple coal lines. Because of the nature of two phase flow, including solid pulverizer coal and primary air, several iterations of throttling action were often required to obtain even a temporary coal line balance of plus or minus 10% of the average flow rate in each pipe. Because of the increased need to maintain good coal flow with low $NO_X$ firing, typical previous trial and error methods have not worked.

A new and improved variable orifice plate for coal pipes in accordance with the present invention is useful in a wide variety of pulverized coal supply systems having multiple coal pipes and is especially well adapted for use in systems for supplying multiple burners of all types of furnaces including "TURBO" furnaces such as that shown and described in U.S. Pat. No. 4,517,904, incorporated herein by reference and sold by the assignee herein under the trademark "TURBO" $_R$.

U.S. Pat. No. 1,477,824 discloses a powdered material firing apparatus employing cylindrically-shaped air valve positioned upstream from the point of coal introduction into the stream.

U.S. Pat. No. 1,708,496 discloses a pulverized fuel burner employing rotatably mounted solid circular damper disks in separate fuel and air conduits connected to supply the burner.

U.S. Pat. No. 2,079,420 discloses a burner for firing furnaces with pulverized coal wherein a pair of semi-circular-shaped valves are provided at the inlet end of the burner for dividing the flow between separate nozzle sections.

U.S. Pat. No. 3,002,472 discloses a comminution system for wet solid materials (coal) including generally circular dampers in coal and air pipes feeding a steam generating unit.

U.S. Pat. No. 4,459,922 discloses an externally adjustable pipe orifice assembly employing pivoted plates.

OBJECTS OF THE INVENTION

It is an object of the present invention to provide a new and improved variable orifice plate for use in a coal pipe connected to supply fuel burning apparatus and more particularly, to provide a new and improved multiple pipe coal supply system for a furnace provided with plural streams of coal and primary air having variable orifice plates in accordance with the present invention installed therein for providing on-line balancing of coal flow to multiple burners.

Yet another object of the present invention is to provide a new and improved coal supply system for an existing or new multiple burner furnace which includes a new and improved orifice plate in each coal pipe for on-line adjusting and balancing coal flow to respective burners.

Still another object of the present invention is to provide a new and improved coal supply system of the character described having pressure taps before and after each orifice plate to measure changes in pressure drop.

Another object of the present invention is to provide a new and improved coal pipe orifice plate apparatus which does not require dismantling of existing coal piping for installation.

Still another object of the present invention is to provide a new and improved coal pipe orifice plate which is readily adjustable to compensate for wear and abrasion, which requires no special tools to operate, which has a removable handle to prevent unintended operation, which has a pressure-tight leak proof seal, which does not tend to accumulate a build up of pulverized coal and which may be constructed of heat and wear resistant material.

Yet another object of the present invention is to provide a new and improved coal pipe orifice plate which can be installed in a neutral position parallel to the flow axis of a coal pipe with a zero pressure drop before testing and set up is commenced to provide a fail safe starting condition.

Still another object of the present invention is to provide a new and improved coal pipe orifice plate which is supported from one side of a coal pipe rather than from two opposite sides and which may be positively locked in a selected position chosen from a plurality of different positions available.

Another object of the present invention is to provide a new and improved coal pipe orifice plate that can be used in conjunction with all types of coal pulverizers.

BRIEF SUMMARY OF THE PRESENT INVENTION

The foregoing and other objects and advantages of the present invention are accomplished in a new and improved flow control apparatus for a coal pipe containing a stream of primary combustion air carrying pulverized solid fuel particles, including a frame sealingly secured to an outside surface of the coal pipe around a window opening formed on one side of the pipe. A circular, single piece, annular orifice plate having an orifice opening at the center is supported for pivotal movement in the coal pipe on a spindle extending radially outwardly from an edge on one side of the orifice plate and out through the window opening.

A bearing sleeve for supporting the spindle for rotating movement about a spindle axis extending transversely of the coal pipe across the center is carried on a mounting plate which closes off the frame.

A removable handle is mounted on an outer end of the spindle for rotating the orifice plate in the coal pipe to vary the effective flow cross-section of the orifice opening to control the flow of coal and primary combustion air.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE INVENTION

Figure 1:
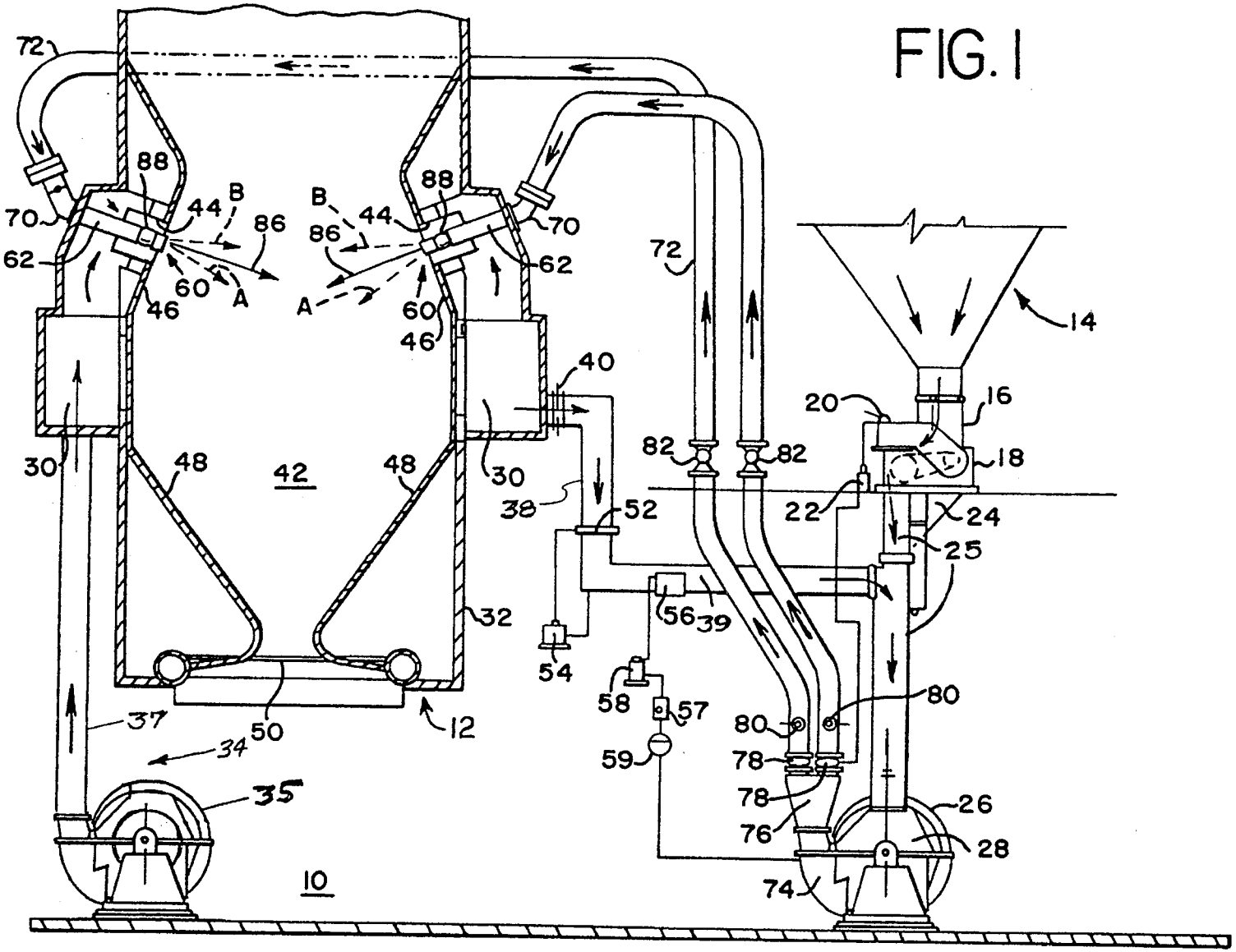
FIG. 1 is a sectional and elevational view of a furnace and fuel supply system in accordance with the features of the present invention.

Referring now more particularly to the drawings, in FIG. 1 is illustrated a new and improved furnace and fuel supply system constructed in accordance with the features of the present invention and referred to generally by the reference number 10.

The furnace and fuel supply system 10 includes an upstanding furnace 12 for burning pulverized coal or other fossil fuels, which fuels may be supplied from a storage system including a hopper 14 in a case when coal is used as fuel, or in tanks, pipelines, etc. (not shown) in cases when other fossil fuels are used.

Coal from the hopper 14 flows down through an outlet in communication with an inlet or feed chute 16 of a drum type coal feeder 18. The feeder 18 is driven by a variable speed drive unit 20 to provide an appropriate fuel feeding rate as controlled by an automatic fuel feed control 22 which is set to respond to the furnace demand for fuel.

Coal from the drum type feeder 18 flows down an outlet chute 24 through a vertical coal feed chute 25 to the inlet side of a coal pulverizer 28 in which the lumps of coal are broken down to a fine powder or dust for burning in the furnace 12. Primary combustion air for the furnace 12 is supplied through a windbox 30 on side walls 32 of the furnace 12. A fan or blower 26 directs primary air and coal into the pulverizer 28. Secondary air supplied from the windbox 30 enters the interior of the furnace 12 through openings 44 in side wall sections 46 of the furnace opening immediately surrounding coal nozzles 60 which supply fuel for the furnace.

A secondary air supply duct system 34 provides secondary air to the windbox 30 and includes a fan or blower 35 having an outlet connected to a duct 37 feeding the windbox. Primary combustion air is taken from the windbox 30 through a shut-off damper valve 40 and is directed into the coal feed chute via branch ducts 38 and 39. Below the windbox 30, the furnace 12 includes inwardly and downwardly sloping wall sections 48 adjacent a lower end 50 of a turbulent combustion chamber 42.

The primary air flow in the duct 38 from the windbox 30 is modulated by a suction control damper 52 which is driven and controlled by a suction controller 54 having a sensor downstream of the damper. The air flow in the duct 39 is modulated by an air temperature damper 56 driven and controlled by a air temperature controller 58 having a sensor on the discharge or outlet side of the coal pulverizer 26. An alarm 57 of a visual or audible type and a temperature indicator 59 are associated with the air temperature controller 58 and the sensor circuit connected to the outlet side of the coal pulverizer 26.

In accordance with the present invention, the furnace 12 is provided with one or more, new and improved, burners 60 constructed in accordance with the features of the present invention. Each burner 60 is centrally disposed in a burner opening 44 in the combustion chamber wall section 46 and includes a main duct or conduit section 62 having a flanged inlet 64 at an outer end secured to an outside wall 66 of the windbox 30 around a circular opening 68 provided therein in coaxial alignment with an associated burner opening 44 in the combustion chamber wall section 46. The inlet flange 64 of the burner 60 is connected to a flanged elbow 70, which in turn is connected to a coal/air pipe 72 for supplying a controlled flow of primary combustion air and pulverized coal to the burner.

Each coal pipe 72 is supplied with primary combustion air which carries the pulverized coal from an outlet duct or section 74 of the coal mill or pulverizer 26. The outlet duct 74 is connected to a transition section 76 having plural outlets, each of which is connected to an air/coal control damper 78 for modulating the flow of primary combustion air and pulverized coal carried thereby to the burner 60 via a coal pipe 72. The air/coal control dampers 78 are controlled and interconnected with the automatic fuel feed controller 22 which controls the drum type coal feeder 18 as previously described.

Upstream of the air/coal dampers 78 each coal pipe 72 is provided with a variable orifice control plate apparatus 80, adjustable to vary the effective cross-sectional flow area through each pipe to more precisely balance and control the amount of primary air and pulverized coal supplied to each burner 60 of the furnace 12. Upstream of the variable orifice control plate apparatus 80, each coal pipe 72 is provided with a shut-off valve 82 for cutting off the supply of primary combustion air and pulverized coal to the furnace 12.

Figure 4:
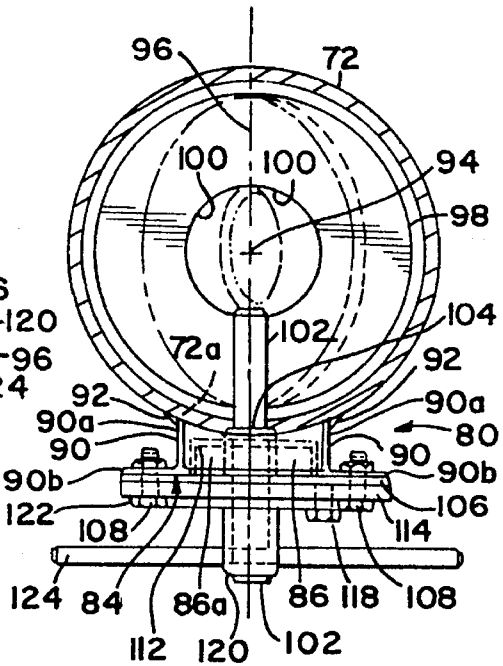
FIG. 4 is a fragmentary, transverse cross-sectional view taken substantially along lines 4—4 of FIG. 2.
Figure 3:
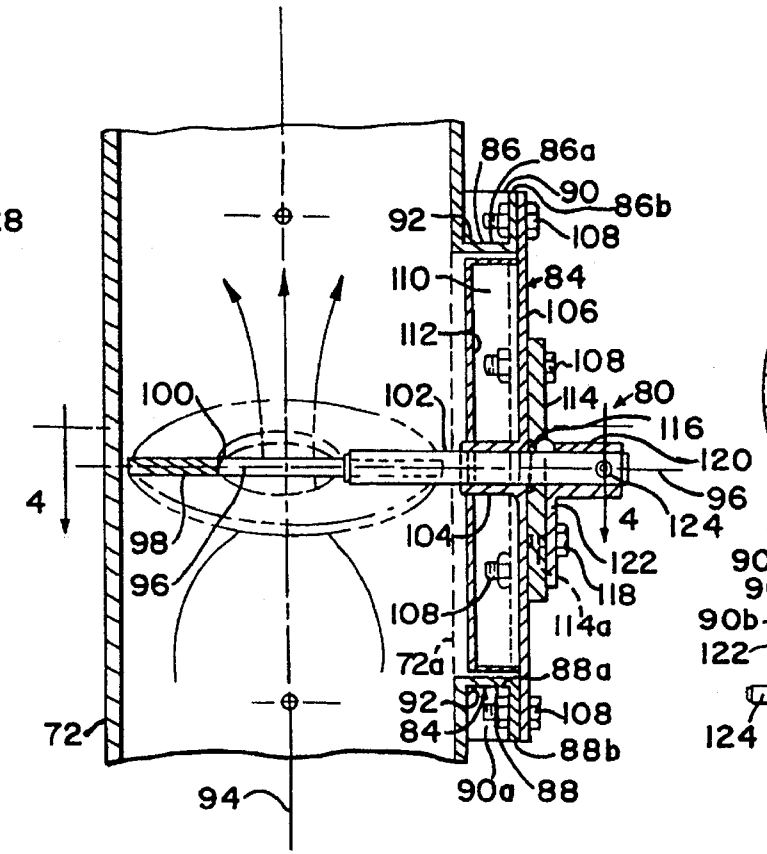
FIG. 3 is a fragmentary, longitudinal cross-sectional view taken substantially along lines 3—3 of FIG. 2.
Figure 2:
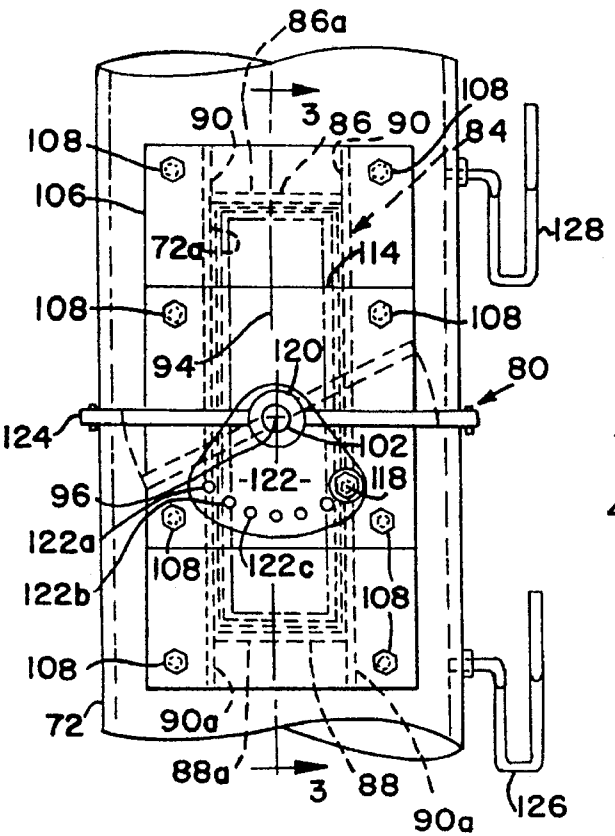
FIG. 2 is an enlarged, fragmentary, elevational view of a coal pipe with a variable orifice plate in accordance with the present invention installed therein of the furnace.

Referring now more particularly to FIGS. 2, 3 and 4, the variable orifice plate control apparatus 80 is adapted to be rapidly installed on existing coal pipes 72 without requiring the dismantling thereof and, of course, is readily installed in new coal piping systems. The apparatus includes a rectangular frame 84 made up of upper and lower angle members 86 and 88, joined at upper and lower ends to opposite side frame angle members 90. The frame 84 is mounted on one side of the coal pipe 72 to surround the edges of a rectangular-shaped window **72*a*** cut from the wall of the coal pipe, usually with a cutting torch or saw.

The angle frame members have flanges **86*a*, 88*a* and 90*a* joined to the wall of the coal pipe 72 by welding 92 extending around the window 72*a* providing a gas tight seal. The angle frame members include face flanges 86*b*, 88*b* and 90*b* at right angles to the flanges 86*a*, 88*b* and 90*b*, respectively, which lie in a common plane spaced outwardly of the coal pipe 72 generally parallel of a longitudinally extending, central flow axis 94. The longitudinal flow axis 94 is intersected at the center of the coal pipe 72 by a radially outwardly extending transverse spindle axis 96 at right angles thereto which is positioned at the center of the rectangular frame 84 as best shown in FIGS. 3 and 4**.

In accordance with the present invention, an annular orifice plate 98 formed of heat and abrasion resistant metal plate is supported in the coal pipe 72 for pivotal movement about the spindle axis 96 between selected different angular positions relative to the coal pipe flow axis 94 for controlling the flow of primary combustion air and coal flowing in the coal pipe.

The annular orifice plate 98 has a circular outer peripheral edge with a diameter slightly less than the inside diameter of the coal pipe 72 as best shown in FIG. 4. The orifice plate 98 is formed with a smaller diameter orifice opening 100 at the center through which a flowing stream of primary air and coal in the coal pipe 72 passes. Because the outer diameter of the orifice plate 98 is less than the inside diameter of the coal pipe 72, some of the primary air and coal stream will flow around the outer periphery of the orifice plate adjacent the inside wall surface of the coal pipe even when the orifice plate is positioned at right angles to the flow axis 94.

The orifice plate 98 is supported from a side edge portion thereof by a spindle 102 having an inner end joined to a radially slotted out edge portion of the orifice plate. The spindle 102 is supported for rotation about the axis 96 in a bearing sleeve 104 extending inwardly toward the window opening 72*a* of the coal pipe from an apertured, rectangular, mounting plate 106 secured to the flanges 86*b*, 88*b* and 90*b* by a plurality of bolt and nut assemblies 108. The mounting plate 106 and the bearing sleeve 104 which is welded thereto are removable by loosening up the bolt and nut assemblies 108 and accordingly, the orifice plate 98 can be easily removed for inspection, repair and replacement when necessary.

A space 110 (FIG. 3) between the window opening 72*a* and the mounting plate 106 may be filled with a box-like channel-shaped filler element 112 which is secured to the mounting plate by welding as best shown in FIG. 3. These intermediate level nut and bolt assemblies 108 are also used to attach an apertured, square-shaped outer stiffening plate 114 at the center of the mounting plate 106. An O-ring seal 116 is provided on the spindle 102 between the mounting plate 106 and the facing inside surface of the stiffening plate 114 to provide a gas tight seal. The stiffening plate 114 is provided with a threaded positioning aperture 114*a* (FIG. 3) offset radially outwardly from a central spindle aperture. The positioning aperture 114*a* is designed to receive a position securing cap screw 118 for securing the orifice plate 98 and spindle 102 in a selected angular position relative to the flow axis 94 of the coal pipe 72.

An outer end portion of the spindle 102 is supported in an outer sleeve 120 which is mounted on a positioning plate 122 having a central aperture for the spindle, and a plurality of position setting apertures 122*a*, 122*b*, 122*c*, etc., spaced radially outwardly of the spindle at different angles representing different angular positions of the orifice plate 98 relative to the flow axis 94 of the coal pipe 72. A handle 124 extends through the outer sleeve 120 and an aperture in the outer end portion of the spindle 102 for rotating the orifice plate 98 and the positioning plate 122 to a selected angular position in the coal pipe 72 wherein a particular aperture 122*a*, 122*b*, 122*c* on the plate 122 is aligned with the threaded positioning aperture 114*a* on the stiffening plate 114. The handle 124 may be removed by withdrawing the handle longitudinally from the outer sleeve 120 and the spindle 102 to prevent unwanted, unintended position changing after a position is selected and the locking cap screw 118 is secured in place.

It will thus be seen that the angular position of the orifice plate 98 relative to the flow axis 94 of the coal pipe 72 is adjustable and lockable in selected positions to provide the desired throttling action on the stream of flowing primary combustion air and coal in the coal pipe. By changing the angular position, the effective flow cross-section in the coal pipe 72 around the outer edges of the orifice plate 98 and through the central orifice opening 100 is changed to provide balanced fuel flow to each of the burners 60 in the furnace 12. When the orifice plate 98 is positioned at right angles to the flow axis 94 (solid lines—FIGS. 2, 3 and 4) a maximum throttling action is obtained and the amount of pressure drop can be measured instantly after a change is made by means of manometers 126 and 128 upstream and downstream of the orifice plate.

Adjustment and changes of the angle of the orifice plate 98 in the coal pipe 72 can be accomplished on-line while the furnace 12 is in operation and results of the changes are known immediately so that orifice plates 98 for each burner 60 can be individually tuned to provide the most efficient furnace operation. It should also be noted that on an initial operational start up after installation of an orifice plate apparatus 84, the orifice plate 98 can be positioned in an in-line or neutral state, parallel to flow axis 94 (zero pressure drop) before testing and setup begin to provide a fail safe starting point.

Installation of the orifice plate assemblies 84 in existing coal pipes 72 is made simpler because the orifice plates 98 are supported in cantilever arrangement on the spindles 102 from one rather than both sides of the coal pipe. Only a single window opening 72*a* on one side of a coal pipe 72 need be made and dismantling of the coal pipe is not required as with other types of two point support axle systems. Moreover, the unique frame 84 and mounting plate 106 in combination permit rapid access to the orifice plate 98 and spindle 102 for servicing, removal and replacement when necessary.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. Flow control apparatus for a coal pipe containing a stream of primary combustion air carrying pulverized solid fuel particles, comprising:

frame means sealingly secured to an outside surface of the coal pipe around a window opening formed on one side of the pipe;

an orifice plate having an orifice opening at the center supported for pivotal movement in said coal pipe on a spindle extending radially outwardly from an edge on one side of said plate through said window opening;

bearing means for supporting said spindle for rotating movement about a spindle axis extending transversely of the coal pipe across the center thereof;

mounting plate means for closing off said frame means and supporting said bearing means mounted thereon; and handle means adjacent an outer end of said spindle for rotating the same to vary the effective flow cross-section of said orifice opening in the coal pipe.

2. The apparatus of claim 1, wherein:

said frame means is formed of angle elements having a rectangular-shaped peripheral flange spaced outwardly of and around said window opening for receiving said mounting plate means.

3. The apparatus of claim 1, wherein:

said orifice plate and spindle are formed of heat and abrasion resistant metal.

4. The apparatus of claim 1, wherein:

said mounting plate means includes inner bearing means extending inwardly thereof toward said window opening supporting said spindle for rotating movement.

5. The apparatus of claim 1, wherein:

said bearing means includes a base extending radially outward of said spindle axis and mounted on said mounting plate means for movement to a selected one of several rotative positions thereon.

6. The apparatus of claim 5, including:

lock means interconnecting said base and said mounting plate means for securing said base in a selected rotative position on said mounting plate means.

7. The apparatus of claim 1, including:

O-ring seal means between said spindle and said bearing means.

8. The apparatus of claim 1, wherein:

said handle means is detachably mounted on said spindle.

9. The apparatus of claim 1, including:

means for measuring static pressure of said stream at position upstream and downstream of said window opening.

10. The apparatus of claim 1, including:

filler plate means in said frame means spaced inwardly of said mounting plate means adjacent said window opening.

11. The apparatus of claim 1, wherein:

said orifice plate has an edge portion formed with a diametrical slot for receiving an end portion of said spindle.

* * * * *